US006004738A

United States Patent [19]

Lau et al.

[11] Patent Number: 6,004,738

[45] Date of Patent: Dec. 21, 1999

[54] PHOTOGRAPHIC ELEMENTS CONTAINING CYAN DYE-FORMING COUPLER, COUPLER SOLVENT AND BISPHENOL DERIVATIVE

[75] Inventors: Philip T. Lau; Stanley W. Cowan, both of Rochester, N.Y.; David Clarke, Watford; Llewellyn J. Leyshon, Waford, both of United Kingdom

[73] Assignee: Eastman Kodak Company, Rochester, N.Y.

[21] Appl. No.: 08/961,116

[22] Filed: Oct. 30, 1997

[51] Int. Cl.[6] ..... G03C 1/08; G03C 7/26; G03C 7/32

[52] U.S. Cl. ..... 430/546; 430/543; 430/551; 430/552; 430/553

[58] Field of Search ..... 430/543, 546, 430/552, 553, 551

[56] References Cited

U.S. PATENT DOCUMENTS

| | | | |
|---|---|---|---|
| 5,451,496 | 9/1995 | Merkel et al. | 430/546 |
| 5,726,002 | 3/1998 | Lau et al. | 430/546 |
| 5,726,003 | 3/1998 | Zengerle et al. | 430/553 |

*Primary Examiner*—Geraldine Letscher
*Attorney, Agent, or Firm*—Arthur E. Kluegel

[57] ABSTRACT

The invention provides a photographic element comprising a light sensitive silver halide emulsion layer containing a cyan dye-forming coupler of formula (I), a phenolic solvent of formula (II) and a bisphenol derivative compound of formula (III):

(I)

(II)

(III)

wherein the substituents are as defined herein the specification.

22 Claims, No Drawings

PHOTOGRAPHIC ELEMENTS CONTAINING CYAN DYE-FORMING COUPLER, COUPLER SOLVENT AND BISPHENOL DERIVATIVE

FIELD OF THE INVENTION

This invention relates to silver halide emulsion layers containing a cyan dye-forming coupler, a phenolic solvent, and a bisphenol derivative. The resulting cyan dyes exhibit an exceptional combination of photographic properties, especially in regard to hue and stability.

BACKGROUND OF THE INVENTION

In any chromogenic photographic material it is desirable that the dyes formed should have certain properties. For instance the dyes should be bright in color, absorbing light in the appropriate spectral region, with very little secondary absorption so that good color reproducibility is obtained. It is also paramount that the formed photographic images should be resistant towards fading due to heat, humidity and light. When the dye images are formed in silver halide photographic materials from the combination of oxidized developer and an incorporated coupler, certain severe restrictions are placed on the properties of the coupler. For instance, the coupler should produce a dye which has the aforementioned desirable priorities. Also the coupler itself must show high efficiency in the dye-forming reaction, must be easily dispersible, must itself be resistant towards the deleterious effects of light, heat and humidity and must have a low propensity to form fog. It is well known in the art of coupler chemistry that when a functionality is incorporated into a molecule to achieve one of the aforementioned desirable properties (such as high dye light stability), quite often one or more of the other desirable properties of the photographically formed dye (such as its hue) is affected adversely. It is very difficult to obtain a coupler which manifests all or even most of the aforementioned desirable properties. There is still, for example, a great need for cyan dye-forming couplers which give rise to dye possessing exceptional stability against the deleterious effects of exposure to heat and humidity, but which at the same time retain a satisfactory level of the aforementioned desirable properties.

Cyan dye-forming couplers of the general structure described in this invention are well known in the art of photography, and it is also well known that image dyes derived from them exhibit excellent resistance to fading by heat and humidity. However, they are deficient in their ability to withstand the effects of light and their absorption bands tend to lie at a shorter wavelength than is desirable, particularly for color paper applications.

It is well know that the absorption characteristics of image dyes can be manipulated by incorporating certain functionalities into the molecular structure and that the chemical environment in which the dye is situated can also influence the hue of the dye. For example, U.S. Pat. No. 5,376,519 and JP 59171953 teach the use of certain phenolic coupler solvents to shift the dye absorption band to longer wavelengths. A disadvantage of the use of these phenolic coupler solvents is that the resultant image is prone to a thermally-induced post-process density enhancement, resulting from morphological changes to the image structure which increase the "covering power" of the dye.

The use of certain cyclic bisphenol phosphate or phosphonate esters to improve the stability of cyan image dyes is taught in U.S. Pat. No. 4,749,645 and JP 02008839. The U.S. Patent does not suggest the advantages of employing a particular phenolic solvent together with a particular type of cyan coupler.

A problem to be solved is to provide a photographic element comprising a cyan dye-forming formulation which yields a cyan image of good hue, and exhibiting exceptional stability against the effects of heat, humidity and light without significant degradation of other photographic properties.

SUMMARY OF THE INVENTION

The invention provides a photographic element comprising a light sensitive silver halide emulsion layer containing a cyan dye-forming coupler of formula (I), a phenolic solvent of formula (II) and a bisphenol derivative compound of formula (III):

(I)

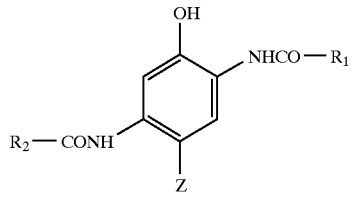

wherein:

$R_1$ represents an alkyl or aryl group;

$R_2$ represents an alkyl or aryl group; and

Z represents hydrogen or a group capable of being split off by oxidized color developer;

(II)

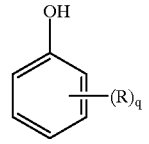

wherein:

each R independently represents a substituent group, and q represents an integer from 1 to 3; and the total of the carbon atoms contained in all of the q R groups is at least 8 and not more than 15 carbon atoms;

(III)

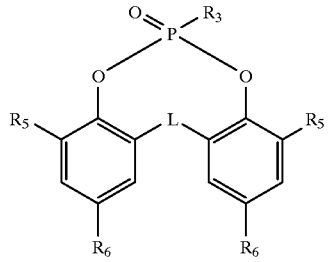

wherein:

$R_3$ represents an alkyl, aryl, alkoxy, or aryloxy group;

L is a linking group having one atom between the phenyl rings;

each $R_5$ independently represents an alkyl group; and each $R_6$ independently represents H or an alkyl group.

The element of the invention provides a cyan image of good hue, and exhibits exceptional stability against the effects of heat, humidity and light without significant degradation of other photographic properties.

DETAILED DESCRIPTION OF THE INVENTION

The combination of the invention is generally as described in the Summary of the Invention. The combination comprises the three compounds (I), (II), and (III).

Cyan Dye-Forming Coupler (I)

Compound I is one type of well-known cyan dye-forming coupler.

(I)

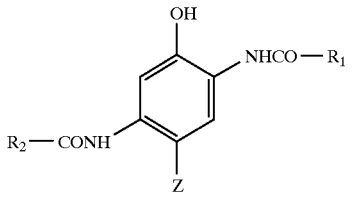

This formula represents a phenolic based coupler having a carbonamido group in both the 2- and 5-positions. In the 4-position, Z is hydrogen or a group capable of being split off by a color developing agent (a coupling-off group or COG). Other cyan dye forming couplers may also be present. Such cyan image dye-forming couplers, generally comprise a phenol or naphthol compound and are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961).

The substituent $R_1$ is an alkyl, aryl of arylamino group. Suitable examples are perfluoroalkyl, anilino and phenyl groups. Desirably, $R_1$ is a phenyl group having an electron withdrawing group having a Hammett's Sigma para value greater than 0 in a position meta or para to the amido group. Values for Hammett's Sigma values may be obtained from "Substituent Constants for Correlation Analysis in Chemistry and Biology" by Hansch and Leo available from Wiley and Sons, New York, N.Y. (1979).

The substituent $R_2$ is an alkyl or aryl group. Suitably it is a group of the formula:

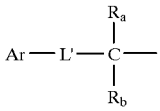

where Ar is an aryl group, L' is a divalent linking group such as —O—, —SO—, or —$SO_2$—, and $R_a$ and $R_b$ are independently H or an alkyl group. In one embodiment, $R_a$ is an alkyl group of up to 3 carbon atoms, $R_b$ is H, and L is —$SO_2$—. In another embodiment, $R_2$ is

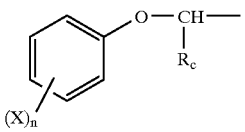

wherein each X is independently a substituent with at least one X being a sulfonamido or sulfamoyl group, n is 1 or 2, and $R_c$ is hydrogen or an alkyl group;

Z is hydrogen or a coupling-off group, suitably a halogen atom or a group linked by an atom of sulfur, oxygen or nitrogen. Chloro groups are conveniently employed.

Examples of cyan couplers of Formula I of the invention are as follows:

I-1

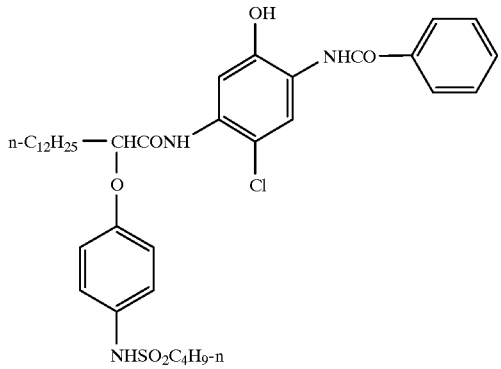

I-2

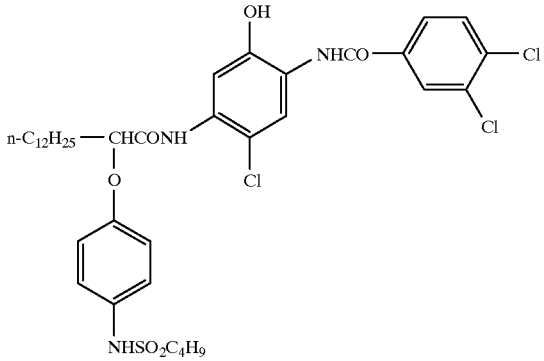

I-3

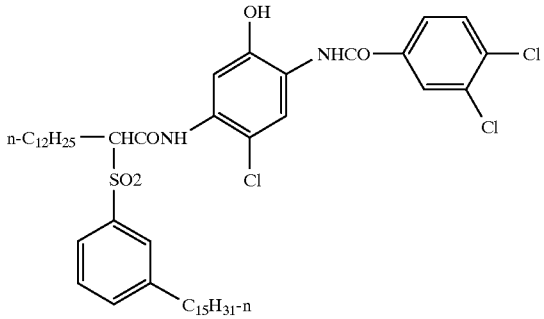

I-4

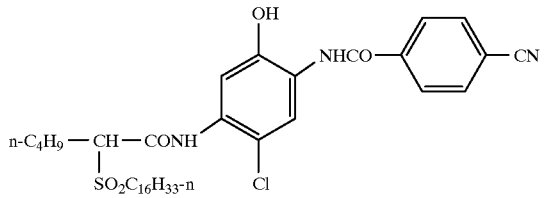

-continued
I-5
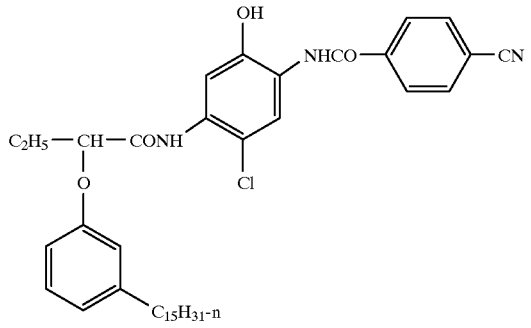
I-6
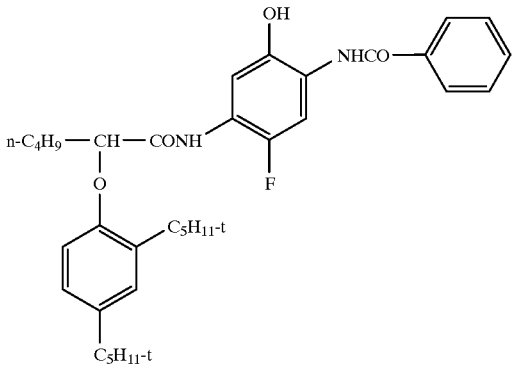
I-7
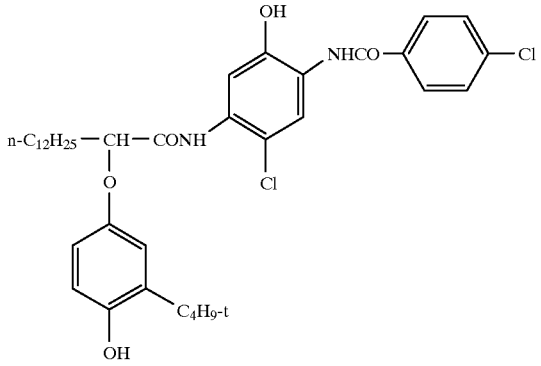
I-8
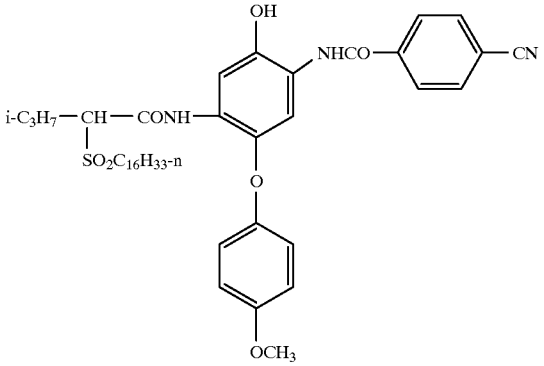
-continued
I-9
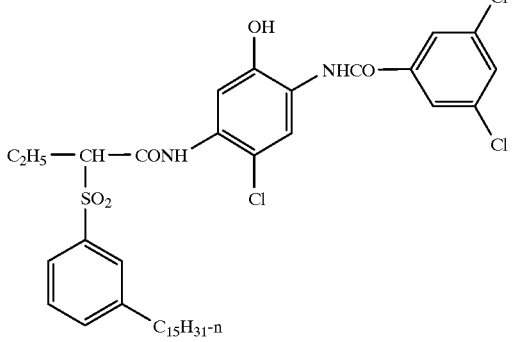
I-10
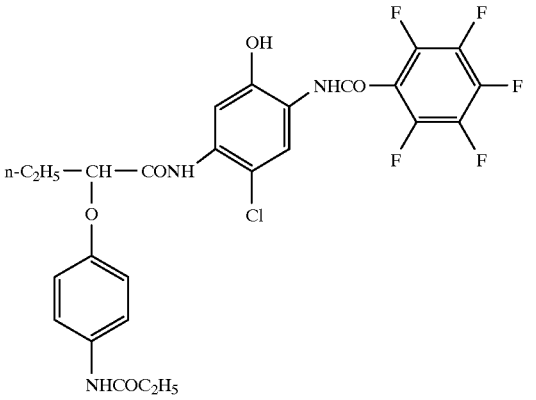
I-11
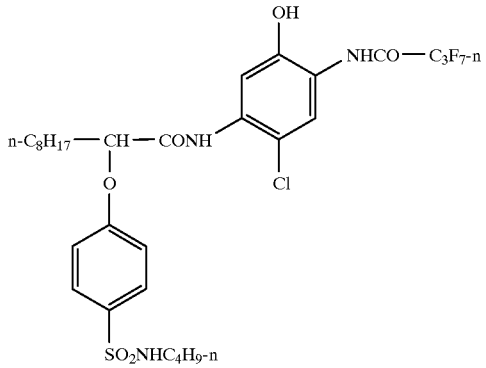
I-12
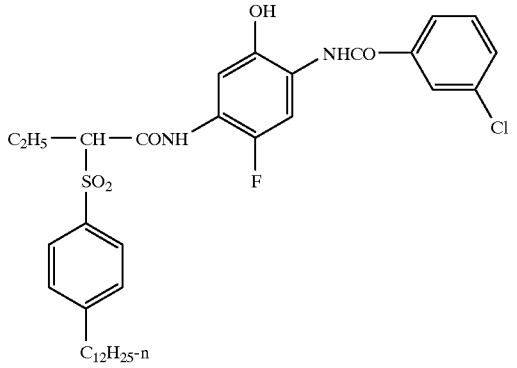

-continued
I-13
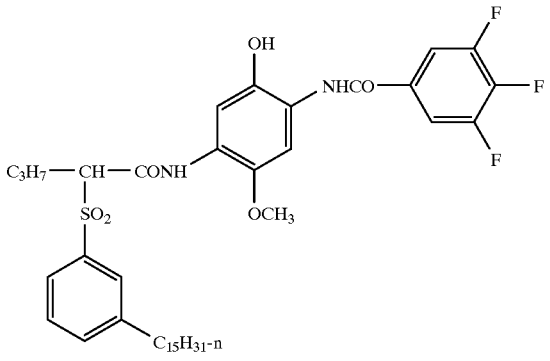
I-14
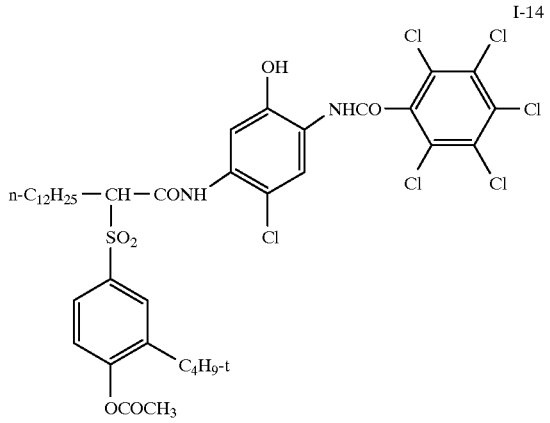
I-15
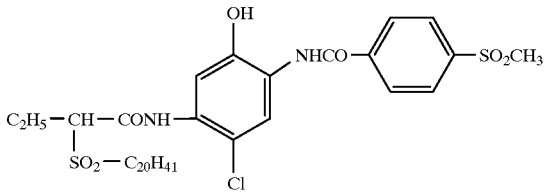
I-16
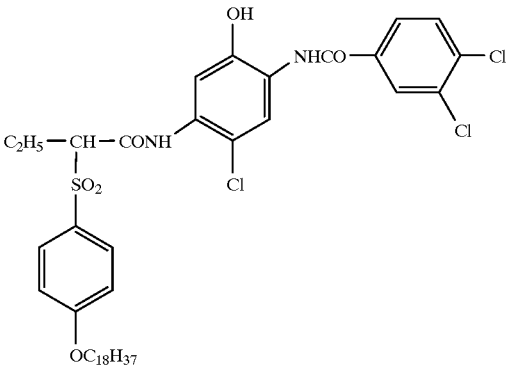
-continued
I-17
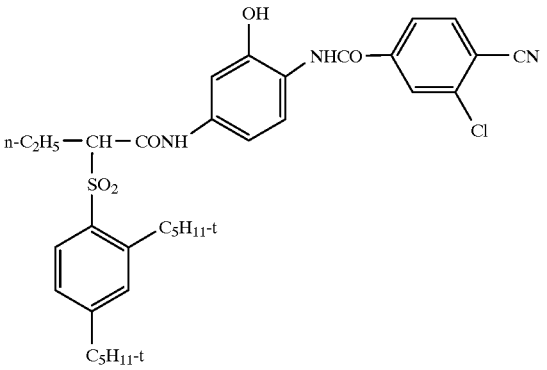
I-18
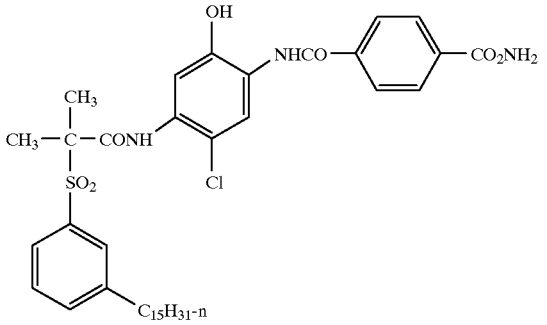
I-19
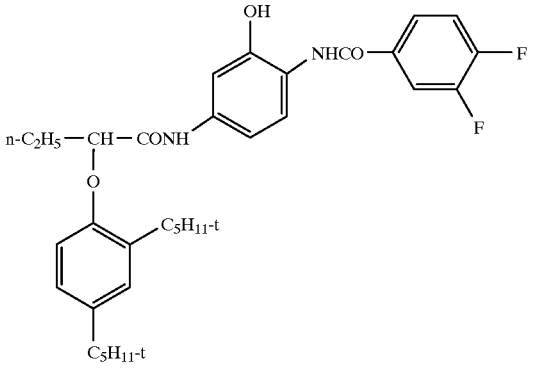
I-20
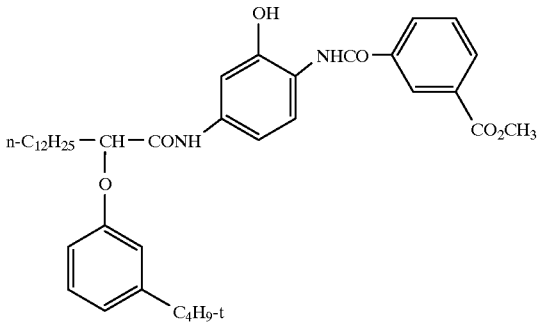

-continued
I-21
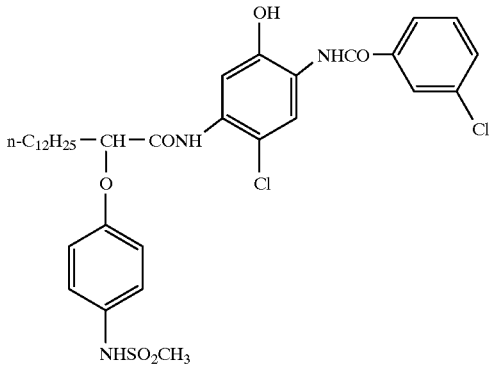
I-22
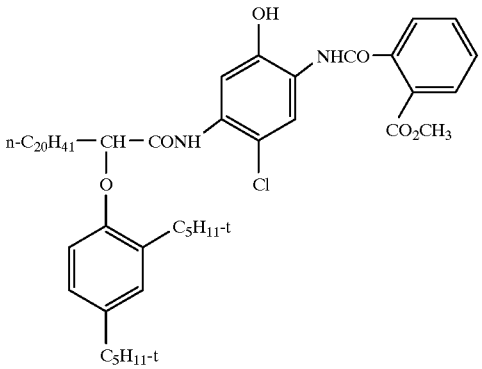
I-23
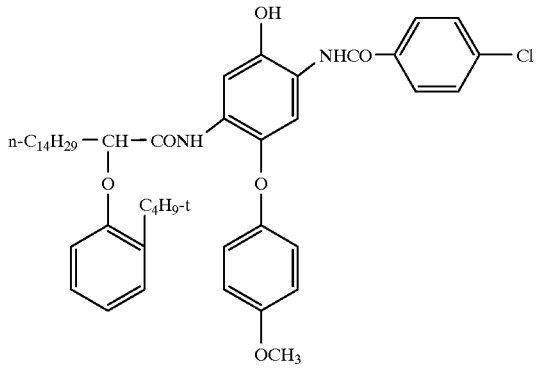
I-24
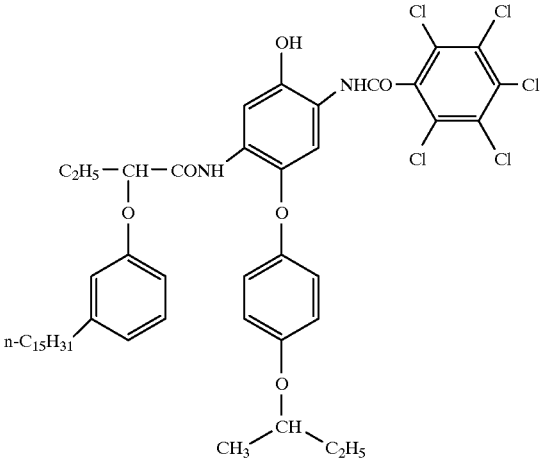
-continued
I-25
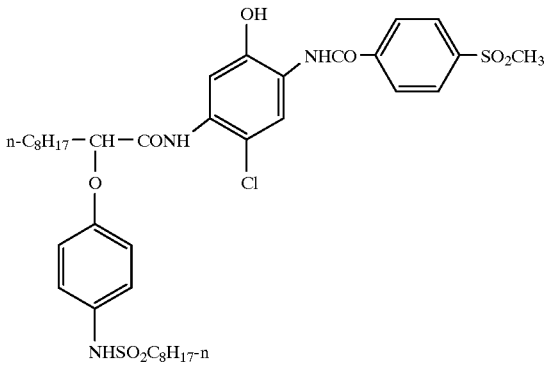
I-26
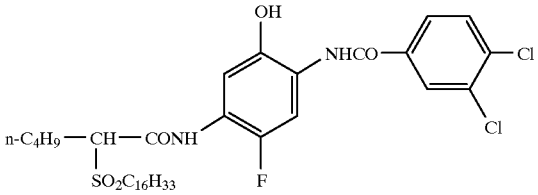
I-27
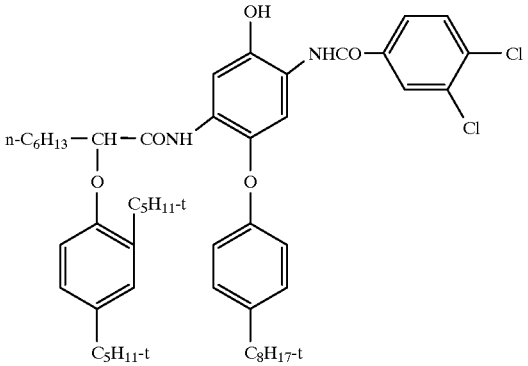
I-28
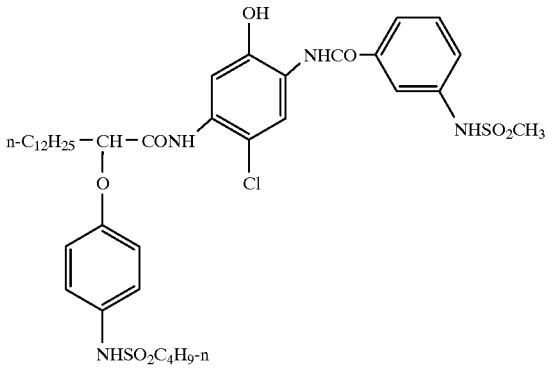

-continued

I-29

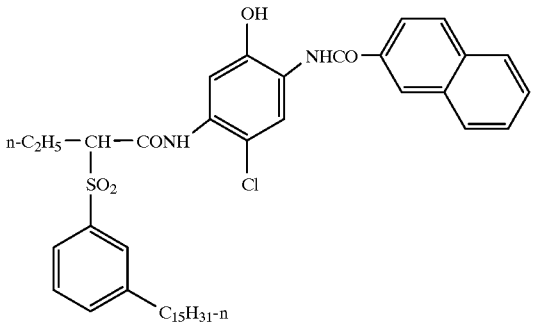

I-30

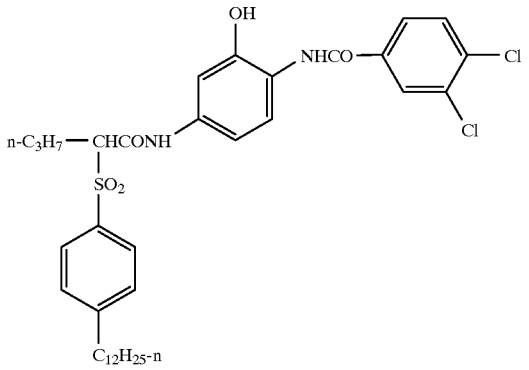

I-31

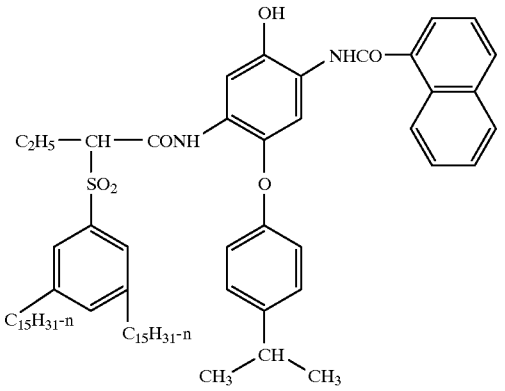

I-32

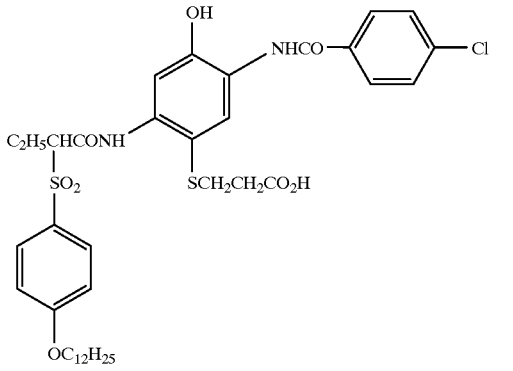

Phenolic Coupler Solvent (II)

The presence of the substituted phenolic coupler solvent II of the invention is required to provide the desirable combination of dye hue and stability of the image dye to light fade.

(II)

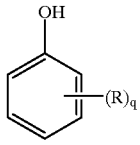

The size of the substituent group(s) is instrumental in accomplishing both of these results. There may be present from 1 to 3 R groups which corresponds to a q value of from 1 to 3. The total number of carbon atoms in the 1 to 3 substituent groups is at least 8 and not more than 15. Suitably, at least one of the groups is an alkyl group. Typical examples are a single alkyl group of 8, 9, 10, 12, or 15 carbon atoms or two alkyl groups of 4 or 5 carbon atoms each.

Examples of phenolic solvents of Formula II of the invention are as follows:

II-1

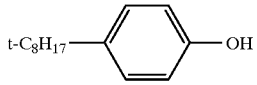

II-2

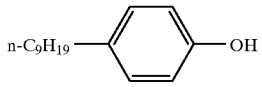

II-3

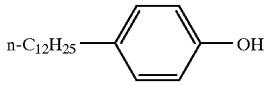

II-4

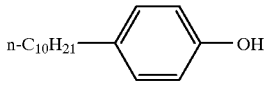

II-5

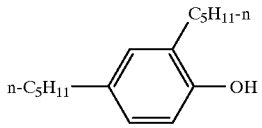

II-6

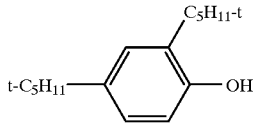

II-7

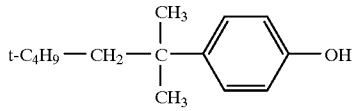

Bisphenol Derivative (III)

The third component of the invention is Bisphenol derivative (III). These derivatives may also be termed heterocyclic phosphorus compounds.

(III)

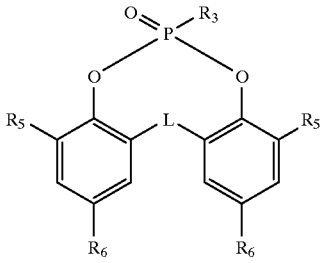

The group $R_3$ represents an alkyl, aryl, alkoxy, aryloxy, or substituted amino group. Suitable examples include methyl, phenyl, ethoxy, phenoxy, and dimethylamino. Each $R_5$ independently represents an alkyl group, and each $R_6$ independently represents H or an alkyl group. Each $R_5$ is desirably a tertiary alkyl group. L may be any linking group that presents a single atom between the two phenyl rings such as —$S(O)_m$—, —O—, or —$C(R_7)(R_8)$— where m is 0, 1, or 2, and $R_7$ and R8 independently represent H or an alkyl group. L may conveniently be —$C(R_7)(R_8)$—.

A preferred Formula (E) is represented by Formula (IIIA).

(IIIA)

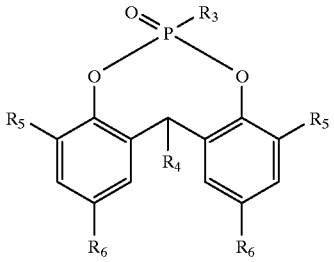

wherein:

$R_3$ represents an alkyl, aryl, alkoxy, aryloxy, alkyl or substituted amino group;

$R_4$ represents H or an alkyl group;

each $R_5$ independently represents an alkyl group; and each $R_6$ independently represents H or an alkyl group; provided that if $R_4$ is H then $R_5$ represents a t-alkyl group.

Examples of bisphenol derivatives of Formula III of the invention are as follows:

III-1

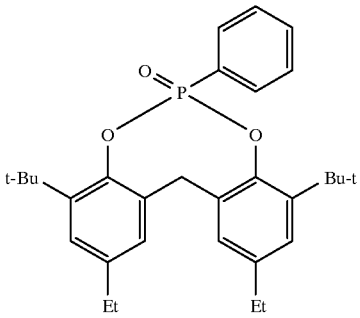

-continued

III-2

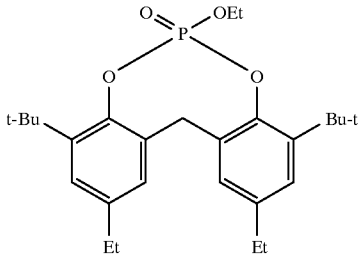

III-3

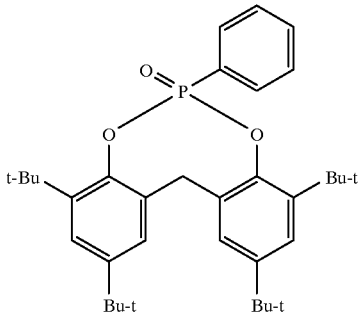

III-4

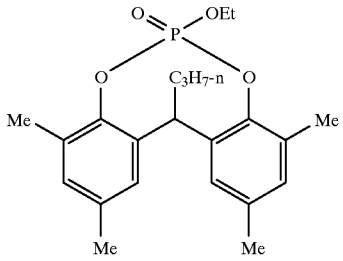

III-5

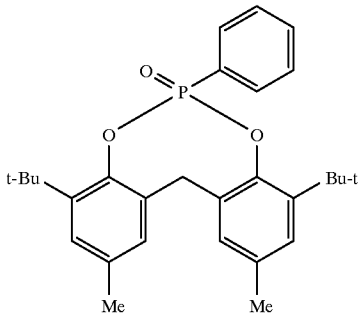

III-6

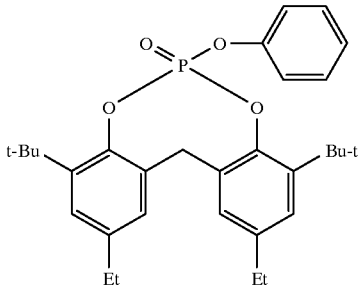

-continued

III-7

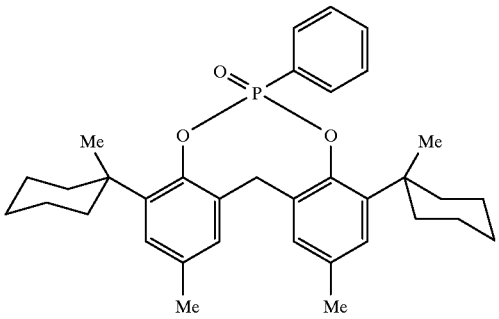

III-8

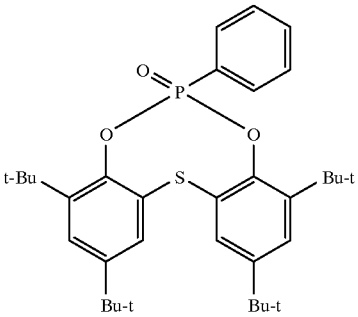

III-9

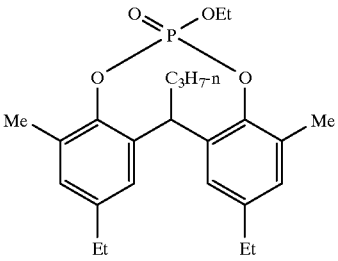

III-10

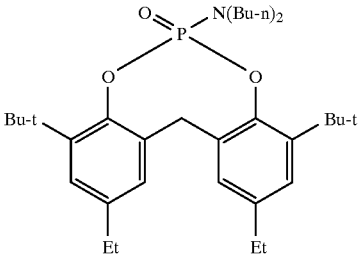

III-11

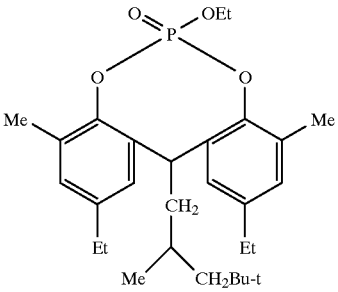

-continued

III-12

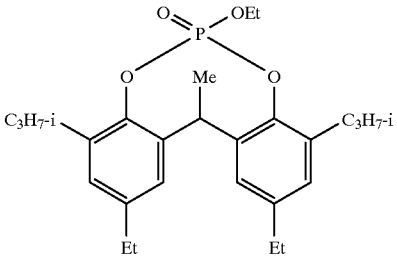

III-13

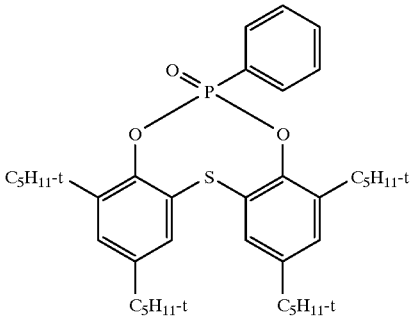

Unless otherwise specifically stated or when the term "group" is used, it is intended throughout this specification, when a substituent group contains a substitutable hydrogen, to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorus, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,23 1; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C.R. Barr, J.R. Thirtle and P.W. Vittum in *Photographic Science and Engineerin,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

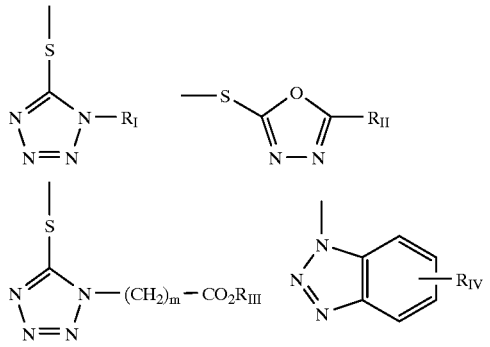

-continued

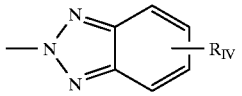

wherein RI is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

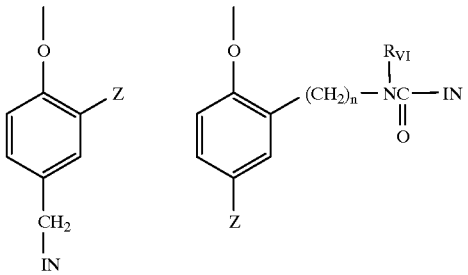

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and 5 unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 15 523,451, U.S. Pat. No. 4,146,396, Japanese Kokai 60-249148 and 60-249149.
Suitable developer inhibitor-releasing couplers for use in the present invention include, but are not limited to, the following:
D1
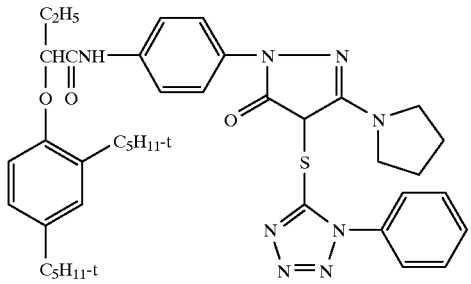
D2
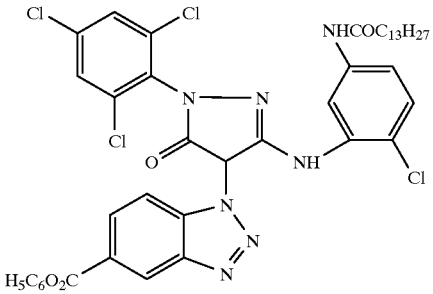
D3
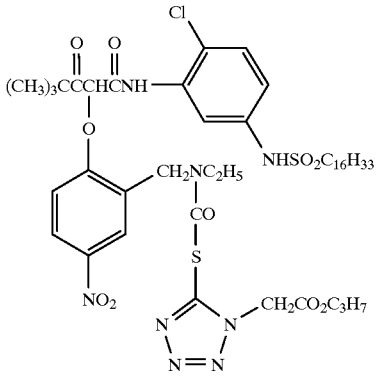
D4
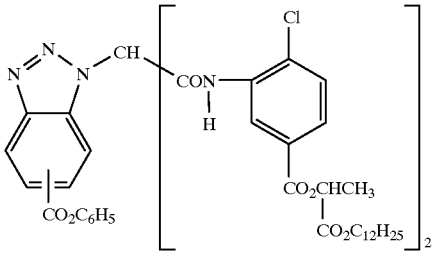
-continued
D5
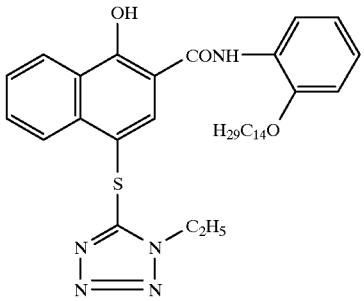
D6
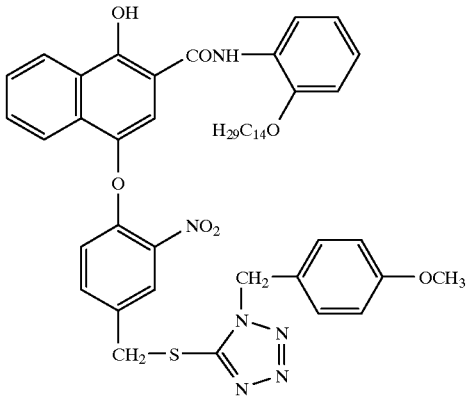
D7
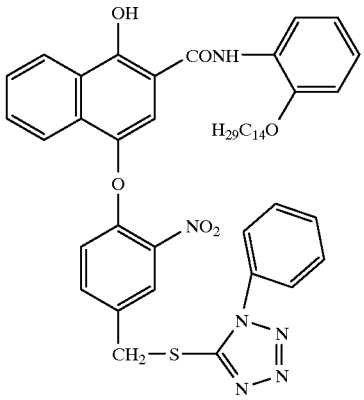
D8
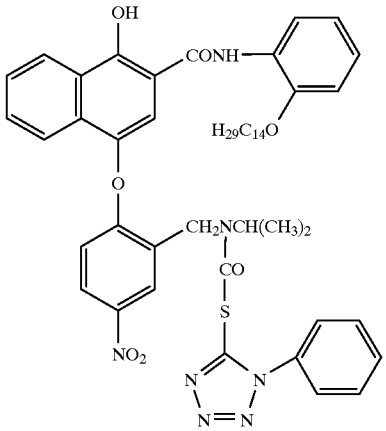

-continued

D9

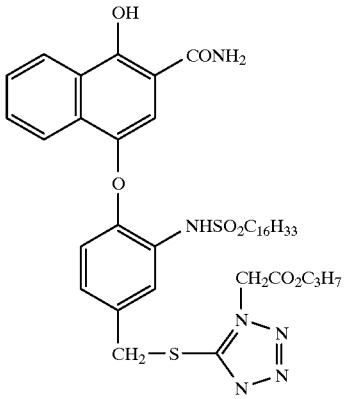

D10

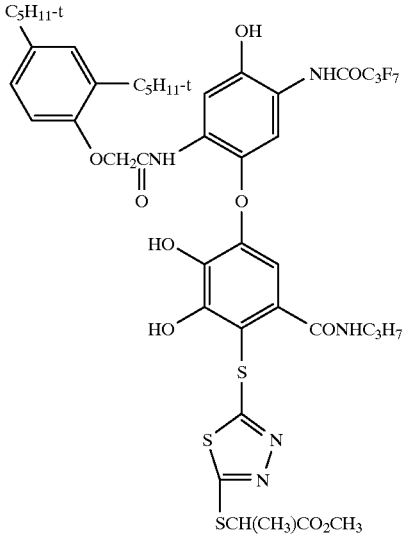

D11

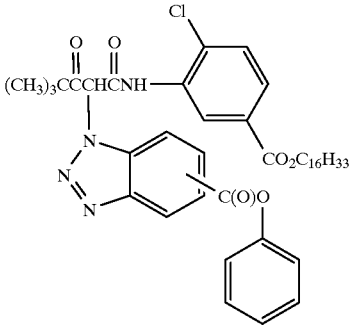

-continued

D12

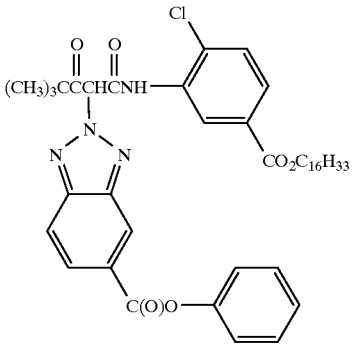

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire PO10 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The print may then be processed to form a positive reflection image using, for example, the Kodak RA-4 process as described in The British Journal of Photography Annual of 1988, Pp 198–199. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

Synthesis

The following examples illustrate the preparation and photographic use of the compounds of this invention. It is to be understood that the invention is not limited to the chosen examples. The synthesis of couplers cited following the general scheme shown below and detailed experimental information is given in Example 1 for coupler I-2.

Scheme

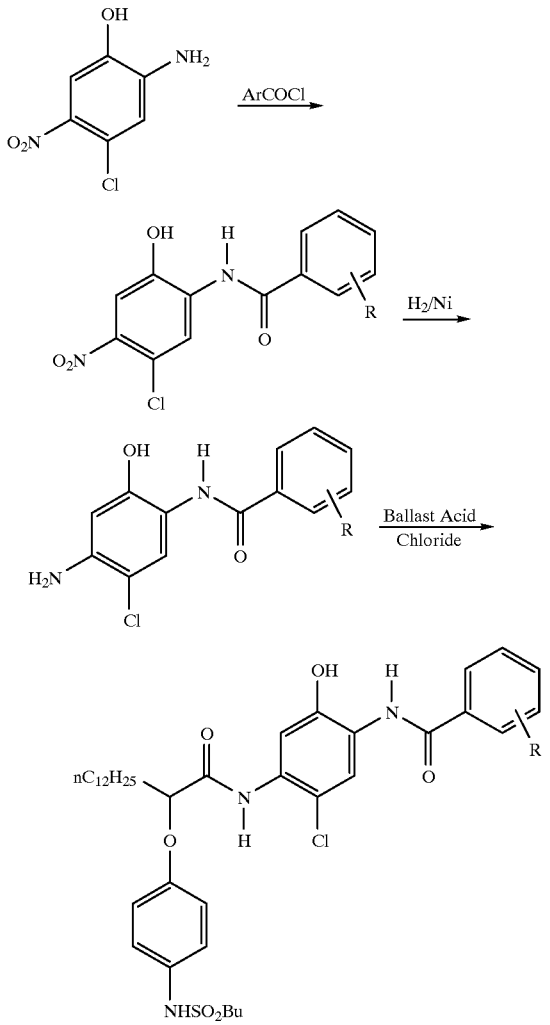

Coupler I-1, R = H
Coupler I-2, R = 3,4-di-Cl

All the phenolic coupler solvents of formula II used in this invention were available either commercially or prepared using standard techniques.

The bisphenol derivative compounds are prepared from the corresponding bisphenol by the scheme below (experimental details are given in Example 2 for bisphenol derivative III-1).

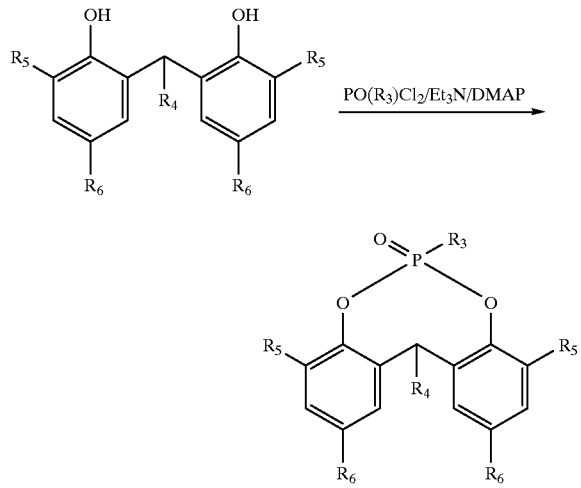

| Bisphenol Derivative | $R_3$ | $R_4$ | $R_5$ | $R_6$ |
|---|---|---|---|---|
| III-1 | Ph | H | t-Bu | Et |
| III-2 | OEt | H | t-Bu | Et |
| III-3 | Ph | H | t-Bu | t-Bu |
| III-4 | OEt | n-Pr | Me | Me |

Example 1

Synthesis of Coupler I-2

(i) Preparation of 2-(3,4-dichlorobenzamido)-4-chloro-5-nitrophenol

2-Amino-4-chloro-5-nitrophenol (34.0g, 0. 18 mole) was slurried in ethyl acetate (250 ml). 3,4-Dichlorobenzoyl chloride (38.g, 0.18 mole) was added and the reaction mixture refluxed for 2 h. After cooling, the beige precipitate was filtered then slurried in hot ethyl acetate (200 ml). Filtration gave the product as a beige solid, 50.5 g, (77%), mp.263–265° C.

Calcd. for $C_{13}H_7Cl_3N_2O_4$: C, 43.2; H, 2.0; Cl, 29.4; N, 7.8% Found: C, 43.0; H, 1.9; Cl, 28.9; N, 7.7%

The correct structure was further confirmed by nmr and mass spectra.

(ii) Preparation of 2-(3.4-dichlorobenzamido)-4-chloro-5-aminophenol

The nitrophenol from (I) (36.0g, 0.1 mole) was taken up in ethyl acetate (250 ml) and dimethylformamide (DMF) (Soml). The solution was hydrogenated over Raney Nickel at 30 atm/25° C. for 15 h. The catalyst was removed by filtration through a Kieselguhr pad and ethyl acetate removed in vacuo. The residual solution of amine in DMF was poured onto ice/water (1500 ml) to precipitate the product, which was collected by filtration and oven-dried. This gave the aminophenol as a pale yellow solid, 27.0 g, (84%), which was used immediately for the next stage. The nmr/mass spectra of the product were consistent with the proposed structure.

(iii) Preparation of Coupler I-2

The amine from the previous stage (16.0 g, 0.05 mole) was dissolved in a mixture of ethyl acetate (250 ml), DMF (50 ml) and pyridine (10 ml). Freshly prepared 2-(4-butanesulphonamidophenoxy)-n-tetradecanoyl chloride (25.0 g, 0.053 mole) in ethyl acetate (50 ml) was added dropwise over 15 minutes, then the product stirred at room temperature of a further 2 h. The brown solution was washed successively with dilute hydrochloric acid and water, then dried over magnesium sulfate. Removal of solvent under reduced pressure gave a brown viscous oil which was crystallized (×2) from a 3:1 60/80 petrol-ethyl acetate mixture to give the final coupler as a white solid, 18.6g, (50%), mp. 166–169° C.

Calcd. for $C_{37}H_{48}C_{13}N_3O_6S$: C, 57.8; H, 6.3; Cl, 13.8; N, 5.5, S, 4.2% Found: C, 58.0; H, 6.2; Cl, 13.6; N, 5.5; S, 4.2%

HPLC gave a purity of 99% and the correct structure was further confirmed by nrnr and mass spectra.

Example 2

Preparation of Bisphenol Derivative III-1

2,2'-Methylenebis(6-t-butyl-4-ethylphenol) (74.0g, 0.2 mole) was dissolved in toluene (300 ml) and stirred in an acetone-ice bath. Triethylamine (46.0 g, 0.45 mole) and 4-dimethyl-aminopyridine (6.0 g, 0.05 mole) were added followed the controlled addition of phenyl phosphonic dichloride (0.22 mole) over 0.5 h. Stirring was allowed to continue at room temperature for a further 16 h., then the heavy precipitate of triethylamine hydrochloride filtered off and discarded. The filtrate was evaporated to dryness the partitioned between ethyl acetate and dilute hydrochloric acid (300 ml each). The organic layer was separated and dried ($MgSO_4$) then solvent removed in vacuo to give the crude product as a viscous oil which gradually solidified. The material was purified by column chromatography in silica, eluting with a 10:1 mixture of 60/80 petrol-ethyl acetate. The product was obtained as a pale yellow solid which was triturated with 60/80 petrol to give colorless crystals, 51.2g, (52%).

Calcd. for $C_{31}H_{39}O_3P$: C, 75.9; H, 8.0% Found: C, 75.7; H, 7.8%

HPLC gave a purity of 99% and the correct structure was further confirmed by nmr/mass spectra.

PHOTOGRAPHIC EXAMPLES

Preparation of Photographic Elements

Elements 101–118

Coupler I-2 and comparison solvent CS-1 were dispersed in aqueous gelatin in the following manner:

Coupler I-2 (5.59 g, 6.88 mmol) was dissolved in a mixture of solvent CS-1 (2.8 g) and ethyl acetate (2 g). The mixture was heated to effect solution. After adding aqueous gelatin (40 g, 10%) containing 0.25% diisopropylnaphthalene sulfonic acid (sodium salt) at 60° C., the mixture was dispersed by ultrasonic agitation for 2 minutes using a Dawe Instruments "Soniprobe" and diluted to 50 grams with water. This dispersion was used in the preparation of the photographic element 101.

Dispersions containing the couplers, stabilizers, and solvents shown for elements 102–118 in Table I were prepared in a similar manner.

On a gel-subbed, polyethylene-coated paper support were coated the following layers:

First Layer

An underlayer containing 3.00 grams gelatin per square meter.

Second Layer

A photosensitive layer containing (per square meter) 1.62 grams gelatin, an amount of red-sensitized cubic silver chloride emulsion containing 0.21 g silver, and a dispersion containing the coupler, stabilizer (if any) and solvent indicated in Table I. The amount of coupler was 0.831 mmol per square meter. The amounts of stabilizer and solvent are shown as weight ratios to coupler.

Third Layer

A protective layer containing (per square meter) 1.00 grams gelatin and 0.084 gram bis(vinylsulfonyl)methyl ether.

The samples prepared as 101 through 118 may be summarized as

TABLE I

| Element | Invention. or Comparison | Coupler | Bisphenol Derivative | Solvent |
|---|---|---|---|---|
| 101 | Comp. | I-2 | None | CS-1, 0.5x |
| 102 | Comp. | I-2 | None | CS-3, 0.5x |
| 103 | Comp. | I-2 | None | II-2, 0.5x |
| 104 | Comp. | I-2 | None | II-3, 0.5x |
| 105 | Comp. | I-2 | None | CS-4, 0.5x |
| 106 | Comp. | I-1 | None | CS-1, 0.5x |
| 107 | Comp. | I-1 | III-3, 0.5x | CS-1, 0.5x |
| 108 | Comp. | I-1 | III-4, 0.5x | CS-1, 0.5x |
| 109 | Comp. | I-1 | III-4, 1.0x | CS-1, 0.5x |
| 110 | Comp. | I-2 | None | CS-1, 0.5x |
| 111 | Comp. | I-2 | None | II-3, 0.5x |
| 112 | Comp. | I-2 | None | II-3, 1.0x |
| 113 | Inv. | I-2 | III-1, 1.0x | II-3, 1.0x |
| 114 | Comp. | I-1 | None | CS-1, 0.5x |
| 115 | Comp. | I-1 | None | II-3, 0.5x |
| 116 | Comp. | I-1 | None | II-3, 1.0x |
| 117 | Inv. | I-1 | III-1, 0.5x | II-3, 1.0x |
| 118 | Inv. | I-1 | III-2, 0.5x | II-3, 1.0x |

Elements 201–212

Coupler I-3 and solvent CS-2 were dispersed in aqueous gelatin in manner:

Coupler I-3 (1.03 g, 1.37 mmol) was dissolved in a mixture of (1.03 g) and ethyl acetate (3.09 g). The mixture was heated to effect solvent CS-2 (1.03 g) and ethyl acetate (3.09 g). The mixture was heated to effect solution. After adding aqueous gelatin (21.93 g, 11.5%) and diisopropylnaphthalene sulfonic acid (sodium salt) (2.52 g 10% solution), the mixture was dispersed passing it three times through a Gaulin homogenizer. This dispersion was used in the preparation of the photographic element 201.

Dispersions containing the couplers, stabilizers, and solvents shown for elements 202–212 in Table II were prepared in a similar manner.

On a gel-subbed, polyethylene-coated paper support were coated the following layers:

First Layer

An underlayer containing 3.23 grams gelatin per square meter.

Second Layer

A photosensitive layer containing (per square meter) 2.15 grams gelatin, an amount of red-sensitized cubic silver chloride emulsion containing 0. 19 g silver, and a dispersion containing the coupler, bisphenol derivative (if any) and solvent indicated in Table II. The amount of coupler was 0.861 mmol per square meter. The amounts of bisphenol derivative are shown as mole ratios to coupler. The amounts of solvent are shown as weight ratios to coupler.

Third Layer

A protective layer containing (per square meter) 1.40 grams gelatin and 0.15 gram bis(vinylsulfonyl)methyl ether.

TABLE II

| Element | Invention or Comparison | Coupler | Bisphenol Derivative | Solvent |
|---|---|---|---|---|
| 201 | Comp. | I-3 | None | CS-2, 1x |
| 202 | Comp. | I-3 | None | CS-2, 2x |
| 203 | Comp. | I-3 | None | II-3, 1x |
| 204 | Comp. | I-3 | None | II-3, 2x |
| 205 | Comp. | I-3 | III-1, 2x | CS-2, 1x |
| 206 | Comp. | I-3 | III-1, 1.5x | CS-2, 0.92x |
| 207 | Inv. | I-3 | III-1, 1.5x | CS-2, 0.46x<br>II-3, 0.46x |
| 208 | Inv. | I-3 | III-1, 1.5x | II-3, 0.92x |
| 209 | Comp. | I-3 | None | CS-2, 0.45x |
| 210 | Comp. | I-3 | None | CS-2, 0.23x<br>II-3, 0.23x |
| 211 | Comp. | I-3 | III-1, 1.6x | CS-2, 0.45x |
| 212 | Inv. | I-3 | III-1, 1.6x | CS-2, 0.23x<br>II-3, 0.23x |

Comparison solvents employed were as follows:

CS-1

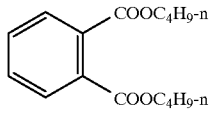

CS-2

$n\text{-}C_8H_{17}CH{=}CH(CH_2)_8OH$

CS-3

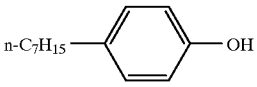

CS-4

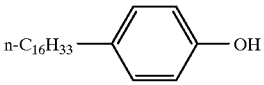

Processing and Evaluation of Photographic Elements

Sample strips of the elements were exposed through a step tablet and processed using Kodak Process RA-4. The Status A red densities of the processed strips were read and sensitometric curves (density vs log exposure) were generated. Reflection spectra of the image dyes were also measured.

The light stability of the image dyes was tested by exposing the processed strips to the light of Xenon arc lamp at an intensity of 50 Klux for four weeks. During this test the strips were covered with a UV-absorbing filter comprising Tinuvin 328 (Ciba-Geigy Corp.) dispersed in gelatin and coated on a transparent film support at a coverage of 1.0 gram per square meter (for elements 101–118) or 0.86 gram per square meter (for elements 201–208).

The dark stability of the dyes was tested by incubating the strips for four weeks in an oven maintained at 75° C. ( except 80° C. for elements 106–113) and 50% relative humidity.

At the end of each of these tests the densities were read again and sensitometric curves were generated. Dye stability was determined as the change in the Status A red density from an initial density of 1.0.

TABLE III

| Sample | Inv. or Comp. | Phenolic Solvent Present? | Bisphenol Derivative Present? | Light Stability Loss from 1.0 | Dark Stability Loss from 1.0 | λmax nm |
|---|---|---|---|---|---|---|
| 101 | Comp. | No | No | −0.30 | −0.01 | 654 |
| 102 | Comp. | CS-3 | No | −0.33 | +0.12 | 664 |
| 103 | Comp. | II-2 | No | −0.22 | +0.05 | 666 |
| 104 | Comp. | II-3 | No | −0.22 | −0.02 | 666 |
| 105 | Comp. | CS-4 | No | −0.61 | −0.02 | 659 |
| 106 | Comp. | No | No | −0.35 | −0.03 | 649 |
| 107 | Comp. | No | III-3 | −0.31 | −0.02 | 645 |
| 108 | Comp. | No | III-4 | −0.29 | −0.02 | 646 |
| 109 | Comp. | No | III-4 | −0.24 | −0.01 | 644 |
| 110 | Comp. | No | No | −0.31 | −0.03 | 653 |
| 111 | Comp. | II-3 | No | −0.24 | −0.04 | 664 |
| 112 | Comp. | II-3 | No | −0.13 | +0.06 | 666 |
| 113 | Inv. | II-3 | III-1 | −0.16 | −0.03 | 660 |
| 114 | Comp. | No | No | −0.34 | −0.01 | 649 |
| 115 | Comp. | II-3 | No | −0.25 | 0 | 659 |
| 116 | Comp. | II-3 | No | −0.16 | +0.10 | 661 |
| 117 | Inv. | II-3 | III-1 | −0.15 | +0.01 | 659 |
| 118 | Inv. | II-3 | III-2 | −0.15 | +0.03 | 658 |

TABLE IV

| Sample | Inv. or Comp. | Inv Phenolic Solvent Present? | Bisphenol Derivative Present? | Light Stability Loss from 1.0 | Dark Stability Loss from 1.0 | λmax nm |
|---|---|---|---|---|---|---|
| 201 | Comp. | No | No | −0.28 | −0.08 | 625 |
| 202 | Comp. | No | NQ | −0.38 | −0.05 | 624 |
| 203 | Comp. | II-3 | No | −0.26 | +0.12 | 627 |
| 204 | Comp. | II-3 | No | −0.04 | +0.29 | 627 |
| 205 | Comp. | No | III-1<br>III-2 | −0.31 | +0.05 | 625 |
| 206 | Comp. | No | III-1 | −0.26 | −0.02 | 625 |
| 207 | Inv. | II-3 | III-1 | −0.17 | −0.03 | 626 |
| 208 | Inv. | II-3 | III-1 | −0.14 | −0.02 | 626 |
| 209 | Comp. | No | No | −0.34 | −0.09 | 625 |
| 210 | Comp. | II-3 | No | −0.27 | −0.07 | 625 |
| 211 | Comp. | No | III-1 | −0.22 | −0.05 | 625 |
| 212 | Inv. | II-3 | III-1 | −0.16 | −0.04 | 625 |

A comparison of samples 101 to 105 shows that a phenolic solvent les 102 to 105 generally provides a longer wavelength of maximum using inventive coupler I-1. Similar results are shown for samples 110–113 using inventive coupler I-2. By comparison, samples 201 to 205 show that the phenolic solvent does not evidence such an effect when used with coupler I-3. The magnitude of the shift was greatest with phenols II-2 and II-3. Little or no esulted when coupler I-3 was used, because the image dye from this highly aggregated and its hue is unaffected by coupler solvents.

In all cases, when phenolic solvents II-2 and II-3 of the invention were present, the light stabilities of the dyes were improved compared to similar coatings containing other solvents. However, in the absence of the bisphenol derivative, these improvements were insufficient to meet the stability needs of modern color photographic papers. Comparison phenols CS-3 and CS-4, on the other hand, were detrimental to light stability (see elements 101 and 104). Note that the alkyl substituents of CS-3 and CS-4 are outside the scope for Formula (II), and thus these phenols are not of the invention.

The dark stability data show that in most of the elements containing phenols the dye densities increased during incubation. This phenomenon is attributed to a morphological change in the dye deposit during the test, akin to smearing of the image, which increases the so-called "covering power" of the dye; that is, the efficiency of the light absorbing process is improved so that the apparent density of the dye deposit increases. Like any significant density change during storage, this is a serious defect of these elements since it is desired that the image remain unchanged during storage.

In all cases, when bisphenol derivatives of the invention were present, the light stabilities of the dyes were improved compared to similar coatings without the bisphenol derivatives. However, the bisphenol derivatives alone were not able to provide sufficient improvements to meet the needs of modern color photographic papers.

It was only in the elements that contained both a bisphenol derivative and a phenolic solvent of the invention that the necessary improvements in light stability were achieved. Furthermore, these elements revealed a completely unexpected advantage, in that the stabilizer suppressed the tendency of the phenols to cause an increase in dye density during incubation.

The entire contents of the patent applications, patents and other publications referred to in this specification are incorporated herein by reference. The invention has been described in detail with particular reference to certain preferred embodiments thereof, but it will be understood that variations and modifications can be effected within the spirit and scope of the invention.

What is claimed is:

1. A photographic element comprising a light sensitive silver halide emulsion layer containing a cyan dye-forming coupler of formula (I), a phenolic solvent of formula (II) and a bisphenol derivative compound of formula (I)

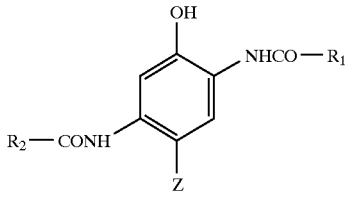

wherein:

$R_1$ represents an alkyl or aryl group;

$R_2$ represents an alkyl or aryl group; and

Z represents hydrogen or a group capable of being split off by oxidized color developer;

(II)

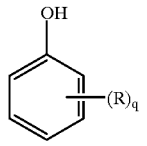

wherein:

each R independently represents a substituent group, and q represents an integer from 1 to 3; and the total of the carbon atoms contained in all of the q R groups is at least 8 and not more than 15 carbon atoms;

(III)

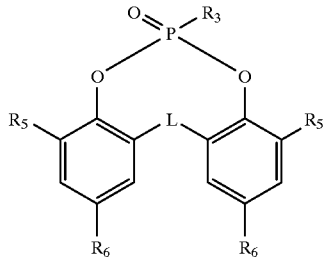

wherein:

$R_3$ represents an alkyl, aryl, alkoxy, aryloxy, or substituted amine group;

L is a linking group having one atom between the phenyl rings;

each $R_5$ independently represents an alkyl group; and each R6 independently represents H or an alkyl group.

2. The element of claim 1 wherein the value of "q" in Formula (II) is 1 and R is an alkyl group.

3. The element of claim 2 wherein R contains 8,9,10, 12, or 15 carbon atoms.

4. The element of claim 1 wherein the value of "q" is 2 in Formula (II) and each R contains 4 or 5 carbon atoms.

5. The element of claim 1 wherein L is represented by —$S(O)_m$—, —O—, or —$C(R_7)(R_8)$— where m is 0, 1, or 2, and $R_7$ and $R_8$ independently represent H or an alkyl group.

6. The element of claim 5 wherein L is represented by —$C(R_7)(R_8)$— where $R_7$ and $R_8$ independently represent H or an alkyl group.

7. The element of claim 1 wherein $R_3$ in Formula (III) represents a phenyl or alkoxy group.

8. The element of claim 1 wherein Formula (III) is represented by Formula (IIIA)

(IIIA)

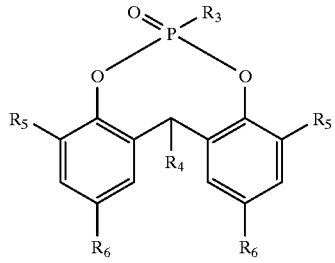

wherein:

$R_3$ represents an alkyl, aryl, alkoxy, aryloxy, or substituted amino group;

R4 represents H or an alkyl group;

each $R_5$ independently represents an alkyl group; and each $R_6$ independently represents H or an alkyl group; provided that if $R_4$ is H then $R_5$ represents a tertiary alkyl group.

9. The element of claim 1 wherein $R_1$ in Formula (I) is a phenyl or perfluoroalkyl group.

10. The element of claim 9 wherein $R_1$ is a phenyl group.

11. The element of claim 1 wherein $R_2$ in Formula (I) is a group of the formula:

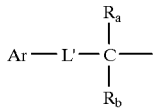

where Ar is an aryl group, L' is a divalent linking group such as —O—, —SO—, or —$SO_2$—, and $R_a$ and $R_b$ are independently H or alkyl.

12. The element of claim 11 wherein L' is $SO_2$.

13. The element of claim 11 wherein $R_a$ is an alkyl group of one to three carbons and $R_b$ is H.

14. The element of claim 3 wherein L of Formula III is represented by —$C(R_7)(R_8)$— where $R_7$ and $R_8$ independently represent H or an alkyl group.

15. The element of claim 4 wherein L of Formula III is represented by —$C(R_7)$(R8)— where $R_7$ and $R_8$ independently represent H or an alkyl group.

16. The element of claim 14 wherein $R_1$ in Formula (I) is a phenyl or perfluoroalkyl group.

17. The element of claim 14 wherein $R_2$ in Formula (I) is a group of the formula:

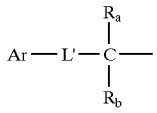

where Ar is an aryl group, L' is a divalent linking group such as —O—, —SO—, or —$SO_2$—, and $R_a$ and $R_b$ are independently H or alkyl.

18. The element of claim 16 wherein L' is $SO_2$.

19. The element of claim 16 wherein $R_a$ is an alkyl group and $R_b$ is H.

20. The element of claim 1 wherein the compounds of Formulas (I) and (III) are dispersed in the solvent of Formula (II).

21. The element of claim 1 wherein $R_2$ of Formula (I) is

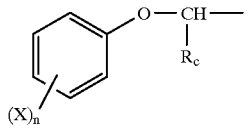

wherein each X is a substituent with at least one X being a sulfonamido or sulfamoyl group, n is 1 or 2, and $R_c$ is hydrogen or an alkyl group; and Z is hydrogen or a coupling-off group.

22. The element of claim 1 wherein Z of Formula (I) is a chloro group.

* * * * *